US005235759A

United States Patent [19]

Rizzuto, Jr.

[11] Patent Number: 5,235,759

[45] Date of Patent: Aug. 17, 1993

[54] REVERSIBLE DIFFUSER FOR HAIR DRYER

[75] Inventor: Leandro P. Rizzuto, Jr., Stamford, Conn.

[73] Assignee: Conair Corporation, Stamford, Conn.

[21] Appl. No.: 934,269

[22] Filed: Aug. 25, 1992

[51] Int. Cl.[5] ..... A45D 20/12

[52] U.S. Cl. ..... 34/97; 34/98; 239/393; 392/380

[58] Field of Search ..... 34/96, 97, 98, 3, 99; 239/101, 389, 390, 393, 397; 392/379-385; 132/271, 212

[56] References Cited

U.S. PATENT DOCUMENTS

| | | | |
|---|---|---|---|
| 3,319,893 | 5/1967 | Rodgers et al. | 239/393 |
| 4,295,283 | 10/1981 | Tomaro | 34/97 |
| 4,316,077 | 2/1982 | Carlson | 34/97 |
| 4,827,105 | 5/1989 | Brown, Jr. | 34/97 |

FOREIGN PATENT DOCUMENTS

| | | | |
|---|---|---|---|
| 140581 | 3/1980 | Fed. Rep. of Germany | 239/393 |

*Primary Examiner*—Henry A. Bennet
*Assistant Examiner*—Denise L. Gromada
*Attorney, Agent, or Firm*—Haynes N. Johnson

[57] ABSTRACT

An air diffuser for attachment to a hair dryer, with a housing containing an air inlet, a hood, and an air outlet from the hood, a face plate having a front side and a rear side and being pivotally mounted in the air outlet so that alternately one or the other of the sides can face outwardly. The face plate has air orifices passing through it and presents a different pattern of orifices on the two sides. One side has fingers mounted extending from it, the fingers including an air passages running within the fingers and through to the other side. That side also has a skirt along its periphery. As a result, the air diffuser provides for a different air diffusion pattern when the front side faces outwardly than when the rear side faces outwardly.

8 Claims, 3 Drawing Sheets

REVERSIBLE DIFFUSER FOR HAIR DRYER

FIELD OF THE INVENTION

This invention relates to personal hair dryers and, in particular, air diffusers to be used in connection with such dryers.

BRIEF SUMMARY OF THE INVENTION

It is often desirable to avoid the harsh, strong flow of warm air from a hair dryer. On those occasions, the air diffuser can be an attached to the air outlet of the hair dryer and will diffuse and soften the flow of air.

In contrast to many diffusers, the diffuser of the present invention has two distinct modes of diffusion, since the face plate through which the air passes is pivoted and can be reversed. With one side exposed, the diffuser is kept at a predetermined distance from the air by extended fingers, and the air is maintained within a skirt, keeping it directed. When the face plate is pivoted so that the other side is exposed, the skirt is eliminated, the air is less directed, and the spacing fingers are eliminated; some of the air outlet holes are also larger, providing a different diffusion pattern. Through partial pivoting, the face plate can be held at an angle, directing air to one side or the other.

DETAILED DESCRIPTION OF THE INVENTION

Figure 1:
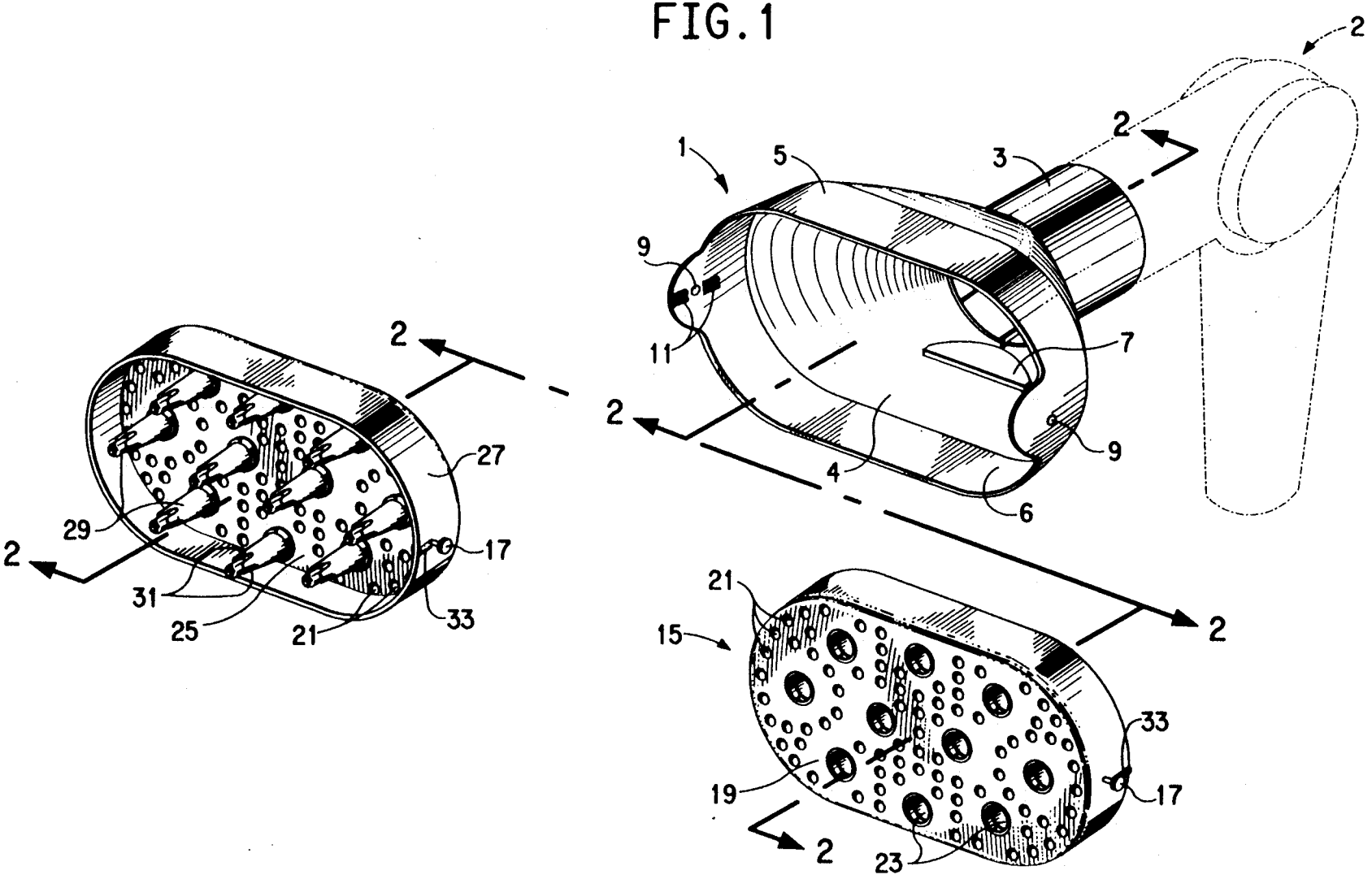
FIG. 1 is an exploded perspective view of my air diffuser, showing the diffuser's face plate in its two positions. The hair dryer upon which it is mounted is shown in phantom.

The air diffuser 1 is made to be mounted on the air outlet of a hair dryer 2, with the air inlet 3 of the diffuser fitting about the air outlet of the dryer.

Air inlet 3 leads to a chamber 4 formed by hood 5. The air outlet 6 from hood 5 can be of any shape desired, but it is preferably generally rectangular with rounded ends. Air deflectors 7 are mounted just downstream of the air inlet 3 to spread the air flow uniformly throughout the hood.

A reversible face plate 15 with pivots 17 at each end is pivotally mounted over the air outlet of hood 5, by mounting pivots 17 in the two pivot holes 9 near the outlet of the hood 5.

Face plate 15 has a front side 19 and a rear side 25, and, due to the pivots, can be rotated so that either side faces outwardly. Front side 19 has a series of small orifices 21 and a series of larger orifices 23. Thus, when front side 19 is facing outwardly, the air from the dryer is diffused through these orifices; and, it will be noted, the face can be held close to the hair, permitting rapid drying.

Figure 2:
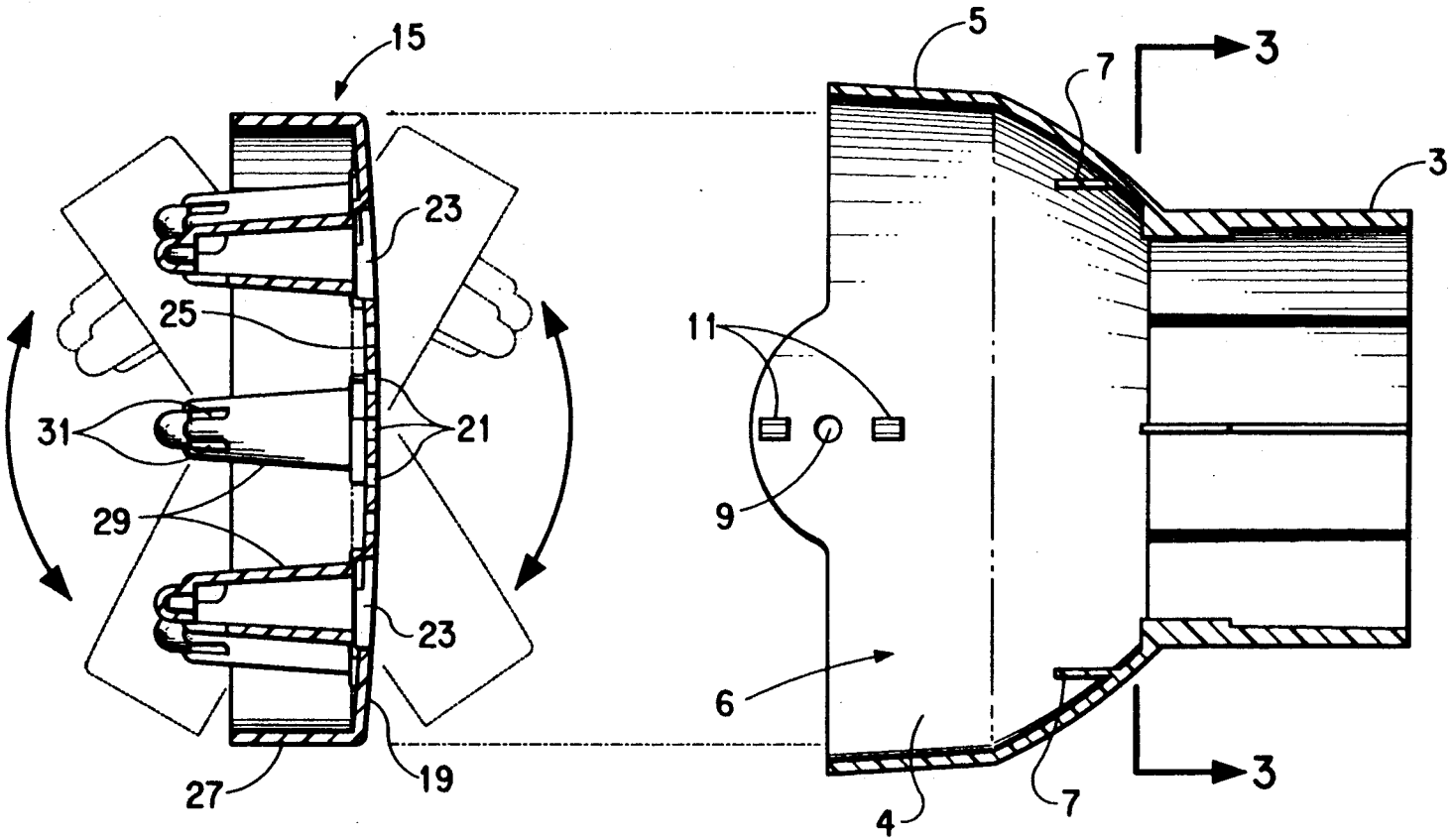
FIG. 2 is a section taken on line 2—2 of FIG. 1, indicating in phantom lines how the face plate can be pivoted.
Figure 3:
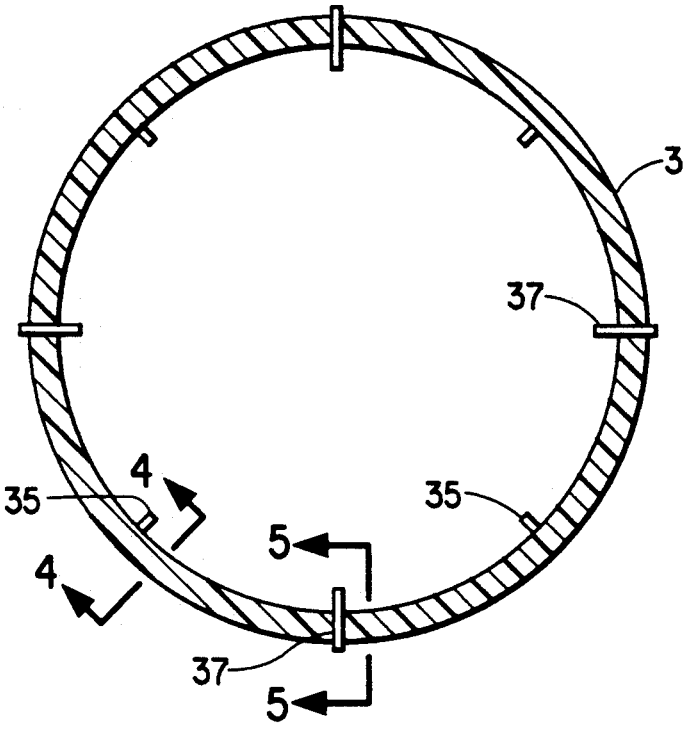
FIG. 3 is a section taken on line 3—3 of FIG. 2, showing the inlet structure for mounting the diffuser on the air outlet of a hair dryer.
Figure 4:
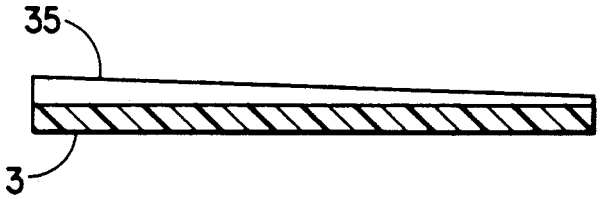
FIGS. 4 and 5 are sections taken on lines 4—4 and 5—5, respectively, giving further details of the mounting structure.
Figure 5:
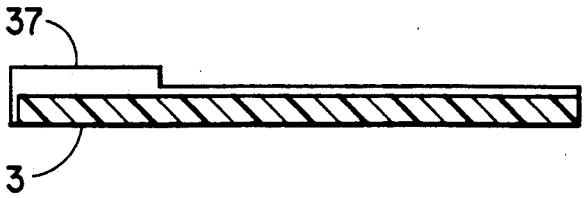

Rear side 25 has a different structure. It has a skirt 27 around its periphery, and fingers 29 extending transversely from its surface. The fingers 29 are hollow and have air openings 31 near their ends. Preferably, the fingers 29 are longer than the width of skirt 27, so that they extend slightly beyond the edge of the skirt (see FIG. 2).

When rear side 25 is exposed, air from the dryer passes through the small holes 21 and also from the holes 31 at the ends of fingers 29. (As can be seen, the base of the fingers 29 serves to form the larger orifices 23 in the front side 19 of the face plate 15). When rear side 25 is exposed, fingers 29 serve to space the unit from the head, while still permitting some air to be released directly into the hair through openings 31. The bulk of the air, however, will come through orifices 21 which are spaced from the hair. Thus, the drying will be more gentle. Even though the diffuser is spaced from the hair, however, the air flow is contained and is directed to the hair by skirt 27.

As can be seen, the two sides have different patterns of orifices.

Detents 33 are provided at each end of skirt 27 and can interengage with complementary slots or grooves 11 in the inside surface of hood 5 to hold face plate 15 in position with either the front side 19 or the rear side 25 exposed. If desired, however, the diffuser can be used with the face plate set at an angle to the outlet of hood 5. If this is done and the rear side 25 is exposed, the diffuser can be held in its best operating position by holding the fingers 29 against the hair.

Air inlet 3 carries angled wedges 35 on its inner surface to receive the air outlet from the dryer and wedge it into place. It also includes stops 37 to limit the depth to which the air outlet can be inserted.

In use, the user mounts the diffuser 1 on the air outlet of dryer 2 and rotates face plate 15 about pivots 17 so that either front side 19 or rear side 25 is facing outwardly. Detents 33 interengage with grooves 11 to hold the face plate in position. The air from the dryer then passes through the face plate and presents a diffused stream of air to the user. The face plate can, of course, be rotated during the course of drying so that the other side is exposed.

I claim:

1. An air diffuser for a hair dryer, said air diffuser including
   - a housing including an air inlet, a hood, and an air outlet from said hood,
   - a face plate having a front side and a rear side and being pivotally mounted in said air outlet, said face plate having air orifices passing therethrough, and
   - said orifices being in a different pattern on said front side than on said rear side,
   - whereby said air diffuser provides for different air diffusion when said front side is facing the user than when said rear side is facing the user.

2. An air diffuser as set forth in claim 1 including fingers extending transversely from one of said sides.

3. An air diffuser as set forth in claim 2 including air orifices in at least some of said fingers.

4. An air diffuser as set forth in claim 1 including a skirt along the periphery of one of said sides, but not the other.

5. An air diffuser as set forth in claim 1 in which said air orifices on said front side are of more than one size and at least some of said air orifices on said rear side are of a size different from that of said air orifices on said front side.

6. An air diffuser for a hair dryer, said air diffuser including a housing including an air inlet, a hood, and an air outlet from said hood, means for securing said air inlet to said hair dryer, a face plate having a front side and a rear side and being pivotally mounted in said air outlet so that one or the other of said sides can be exposed, said face plate having air orifices passing therethrough, fingers mounted on one of said sides and extending transversely therefrom, and said fingers including an air passage running from said fingers through to the other of said sides, whereby said air diffuser provides for a different air diffusion pattern when said front side is facing the user than when said rear side is facing the user.

7. An air diffuser as set forth in claim 6 including locking means for holding said face plate with one or the other of said sides facing the user.

8. An air diffuser as set forth in claim 6 including a skirt along the periphery of the said side having said fingers.

* * * * *